United States Patent [19]

Wendling et al.

[11] Patent Number: 4,650,004

[45] Date of Patent: Mar. 17, 1987

[54] PORTABLE DRY CHEMICAL FIRE EXTINGUISHER

[75] Inventors: Paul R. Wendling, Akron; Lloyd D. Sampson, Uniontown, both of Ohio

[73] Assignee: The Goodyear Tire & Rubber Company, Akron, Ohio

[21] Appl. No.: 666,011

[22] Filed: Oct. 29, 1984

[51] Int. Cl.[4] ..... A62C 35/18

[52] U.S. Cl. ..... 169/85; 239/325

[58] Field of Search ..... 239/327, 328, 325; 169/85, 88, 73, 30, 35; 74/105, 104

[56] References Cited

U.S. PATENT DOCUMENTS

| | | | |
|---|---|---|---|
| 2,533,685 | 12/1950 | Nurkiewicz | 169/88 |
| 2,580,448 | 1/1952 | Mapes et al. | 169/88 |
| 2,731,093 | 1/1956 | Gordon | 169/35 |
| 2,865,458 | 12/1958 | Simoncini et al. | 169/35 |
| 3,263,515 | 8/1966 | Adamski | 74/105 |
| 3,618,669 | 11/1971 | Sachs | 169/85 |
| 3,733,309 | 5/1973 | Wyeth et al. | 426/127 |
| 3,858,659 | 1/1975 | Fukushima | 169/88 |

*Primary Examiner*—Andres Kashnikow
*Assistant Examiner*—Kevin Patrick Weldon
*Attorney, Agent, or Firm*—Marc R. Dion, Sr.

[57] ABSTRACT

A fire extinguishing apparatus for dispensing a dry chemical agent from a container by using a suitable supply of compressed gas such as carbon dioxide. The compressed gas is used to fluidize the chemical agent and carry the agent to a hand manipulated nozzle which is aimed at the fire. The extinguishing apparatus is actuated by removing a safety pin from the actuating lever, depressing the lever depresses a plunger valve that opens a passage from the container to the nozzle outlet and simultaneously transfers a linear motion to a tubular spool through a connecting lever. The tubular spool punctures a seal on a compressed gas cartridge releasing the gas into the container aerating the dry chemical and transporting it through the open plunger valve and out the nozzle.

5 Claims, 2 Drawing Figures

PORTABLE DRY CHEMICAL FIRE EXTINGUISHER

TECHNICAL FIELD

Figure 1:
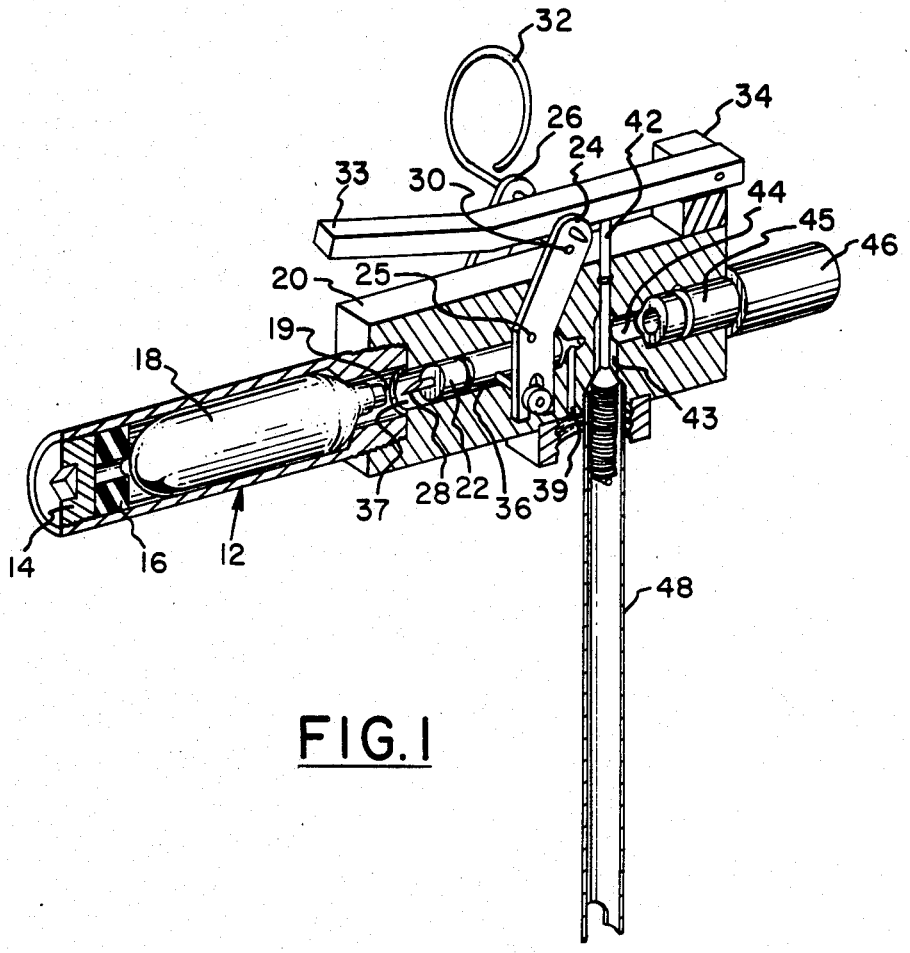

This invention relates to fire extinguishers. More particularly, it relates to fire extinguishers having plastic fire extinguishing agent containers as well as to an apparatus for dispensing a fire extinguishing agent from a container which is especially suited for use with a plastic container.

BACKGROUND ART

Several types of fire extinguishers have been employed for discharging dry chemical extinguishing agents. One type is known as the stored pressure type where dry chemical is maintained in a container under pressure. To release the dry chemical, a valve on the container is opened and the dry chemical is discharged through a nozzle.

Another type, for larger fires, has the container mounted on a vehicle to be taken to the site of the fire where the dry chemical, under stored pressure, is discharged through a length of hose having a nozzle at the end.

Still another type is known as the cartridge type. In this type, the dry chemical is maintained in a storage container and a suitable supply of gas such as compressed carbon dioxide, nitrogen, etc. is maintained in a cartridge connected to the container. Upon actuation of the device, the gas is fed into the dry chemical container to fluidize or aerate the dry chemical. Upon opening a valve, the fluidized dry chemical is then fed from the container to a hand manipulated nozzle which is aimed at the fire. This type has been disclosed in U.S. Pat. 2,531,123 to Guise et al.

The containers for these dry chemical type extinguishers have heretofore been made of metals, such as brass, steel, stainless steel and aluminum. As such, they suffer the disadvantages of being non-transparent, relatively heavy, and economically impractical to be disposable. Furthermore, to recharge these extinguishers, it is normally required that they be returned to a factory or service representative for replacement of the dry chemical agent and either repressurizing the container or replacement of the gas cartridge.

While pressure gages are normally used in the stored pressure types as an indication of whether or not the extinguisher has been used, the opaqueness of the containers affords no indication as to the presence or absence of the dry chemical agent.

DISCLOSURE OF THE INVENTION

In accordance with the practice of the present invention there is provided a fire extinguisher comprised of:

(a) a dispensing apparatus, and (b) a container for a fire extinguishing agent wherein the container is comprised of a thermoplastic material.

There is also disclosed an apparatus for dispensing a fire extinguishing agent, which is especially suited for use with a plastic container comprised of:

(a) a body having (1) a gas channel having a gas entry port at one end thereof and a gas exit port at the other end, (2) an agent channel having an agent entry port at one end thereof and an agent discharge port at the other end, (3) a gas cartridge having a puncturable seal, located at said gas entry port, and (4) means for detachably connecting the body to a container of fire extinguishing agent wherein said gas exit port and said agent entry port are located to operate through said connecting means, (b) means for releasing pressure from the gas cartridge through the gas channel, and (c) means for discharging the agent through the agent channel.

The thermoplastic material which comprises the container of the present invention is preferably a biaxially oriented thermoplastic, most preferably a biaxially oriented polyethylene terephthalate.

Figure 2:
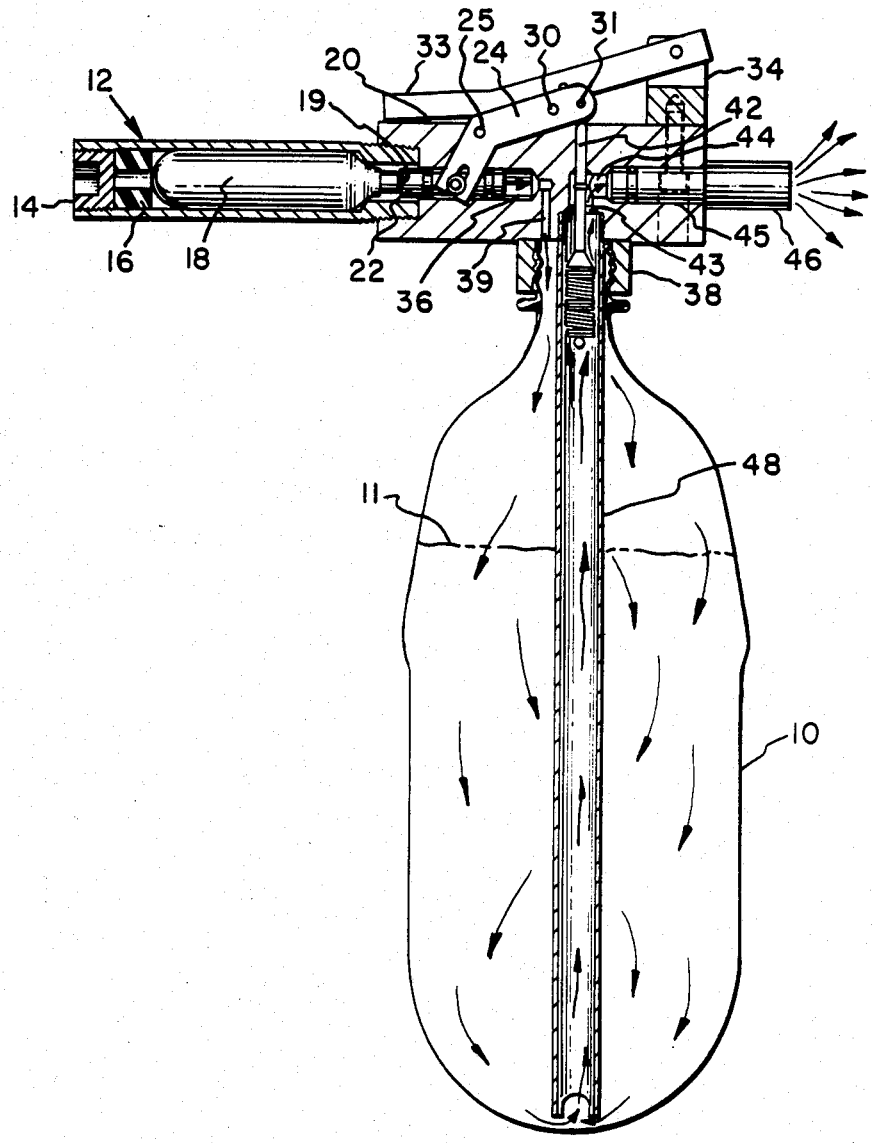

For a better understanding of the invention, the following description of the operation of the dispensing means and the fire extinguisher should be taken with reference to the attached drawings wherein;

FIG. 1 is a perspective view, in section, of the dispensing apparatus showing the apparatus in the standby mode, and FIG. 2 is an elevational view, in section, of the fire extinguisher showing the dispensing apparatus in the dispensing mode with the arrows indicating the flow of gas into the container and the flow of extinguishing agent from the container.

Removing the safety pin (32) from the three openings (31) in the two angular arms (24, 26) and the actuating lever (33) allows the lever (33) to be depressed about its pivot point (25) of attachment to the lever bracket (34). Depressing the lever (33) concurrently depresses the roll pin (30) and the plunger valve (42). Depressing the roll pin (30), which connects the angular arms (24, 26), causes the arms to rotate about their pivot points (25) of attachment to the body (20) thereby sliding the tubular spool (22) with the puncture pin (28) attached toward the gas cartridge (18) in order to pierce its puncturable seal (19). The gas cartridge (18) is located within the handle (12) at the gas entry port (37) and is held in place by the resilient spacer (16) and the plug (14). Upon puncturing the seal (19), compressed gas is released from the cartridge (18) to flow through the tubular spool (22), located within the gas channel (36), through the exit gas port (39) into the opening of the container (10) above the level of the extinguishing agent (11). The container (10) is connected to the body (20) by the detachable connector (38).

Depressing the plunger valve (42) opens the discharge path allowing the extinguishing agent (11) to go from the pressurized port container (10) through the dip tube (48) attached at the agent entry port (43), the agent channel (44) and the nozzle (46) located at the agent exit port (45) to be directed at the fire.

The fire extinguishing agents which can be used with the present invention are normally of the dry chemical types such as ammonium phosphate, sodium bicarbonate, potassium bicarbonate, urea potassium bicarbonate and potassium chloride. In addition, any liquid agent can be used which is not detrimental to the integrity of the container, either physically or chemically.

The containers to be used with the dispensing apparatus of this invention can be made of any of the conventional materials commonly used, however, it has been discovered that the dispensing apparatus is particularly suitable with containers made from thermoplastic materials. Particularly useful are thermoplastics which are translucent which provide a visual indication of the presence or absence of the fire extinguishing agent.

Typical of the thermoplastics which may be used in the practice of this invention is polyethylene terephthalate. Another advantage to the use of thermoplastics is their relatively lower weight to volume ratios over the commonly used metal container. For instance, a 1.6 liter spun aluminum container from a commercially available fire extinguisher weighed 600 g; while a larger 2 liter polyethylene terephthalate bottle weighed only 70 g. Particularly useful are the biaxially oriented polyethylene terephthalate bottles such as are described in U.S. Pat. No. 3,733,309, which is hereby incorporated by reference.

The dispensing apparatus of the present invention can be made of any material or combination of materials suitable to accomplish its mechanical operation. The gas cartridges which can be used in the dispensing apparatus include commercially available cartridges such as Crosman Powerlet, No. 231/5 containing compressed carbon dioxide.

EXAMPLE 1

A 2 liter polyethylene terephthalate bottle, commonly used in the soft drink industry, was filled with 908 g of a sodium bicarbonate fire extinguishing agent. The bottle was connected to a dispensing apparatus fabricated according to the drawing in FIG. 1 resulting in a fire extinguisher as shown in FIG. 2. A Crosman Powerlet No. 231/5 cartridge containing 12 g of carbon dioxide was inserted into the handle followed by the spacer and plug. The safety pin was removed and the actuating lever was depressed resulting in the discharge of the extinguishing agent from the bottle through the discharge nozzle.

A benefit of using a gas cartridge and a thermoplastic container is that both may be discarded after use and readily replaced with fully charged ones to provide a recharged fire extinguisher. In addition, the ability of a gas cartridge to have its pressure released on demand precludes the possibility of loss of pressure over time as may occur in the conventional stored pressure type of fire extinguisher.

While certain representative embodiments and details have been shown for the purpose of illustrating the invention, it will be apparent to those skilled in this art that various changes and modifications may be made therein without departing from the scope of the invention.

What is claimed is:

1. An apparatus for dispensing a fire extinguishing agent comprised of:

(a) a body having (1) a gas channel having a gas entry port at one end thereof and a gas exit port at the other end, (2) an agent channel having an agent entry port at one end thereof and an agent discharge port at the other end, (3) a gas cartridge having a puncturable seal, located at said gas entry port, and (4) means for detachably connecting the body to a container for a fire extinguishing agent wherein said gas exit port and said agent entry port are located to operate through said connecting means, (b) means for releasing pressure from the gas cartridge through the gas channel comprised of:

(1) a tubular spool located in the gas channel of the body pivotally attached to a pair of angular arms, one on each side of the spool, (2) a puncture pin, for puncturing the puncturable seal, attached to the spool, (3) a pair of angular arms, located on each side of the body and extending upwardly, pivotally attached at corresponding ends to the spool, connected together at a distance from the other ends by means of a roll pin, pivotally connected at corresponding intermediate points to each side of the body, and (4) an actuating lever, pivotally attached at one end to a lever bracket attached to the body in cooperating relationship with the roll pin between the angular arms, wherein depressing the actuating lever against the roll pin rotates the angular arms which cause the tubular spool and puncture pin to move toward the gas cartridge where the puncture pin punctures the seal thereby releasing the gas pressure through said gas channel, and (c) means for discharging the agent through the agent channel.

2. The dispensing apparatus of claim 1 wherein the means for discharging the agent is comprised of:

(a) a plunger valve having a seat and a stem, the seat being sealingly engaged with the agent entry port and the stem extending vertically therefrom through a hole in the body to contact the actuating lever, (b) a dip tube, connected to the body at the agent entry port, and of sufficient length to extend downwardly near the bottom of an agent container, and (c) a nozzle, located at the agent exit port wherein the plunger valve is opened by depressing the actuating lever allowing the extinguishing agent to pass through the dip tube, the plunger valve, the agent channel and the nozzle to be directed to a fire.

3. The dispensing apparatus of claim 2 wherein the gas cartridge is located within a handle attached at the gas entry port of the body.

4. A fire extinguisher comprised of:

(a) the dispensing apparatus according to cliam 1, and (b) a container for a fire extinguishing agent, detachably connected to the dispensing apparatus.

5. The fire extinguisher of claim 4 wherein the container is a biaxially oriented polyethylene terephthalate.

* * * * *